US006230557B1

(12) United States Patent
Ciglenec et al.

(10) Patent No.: US 6,230,557 B1
(45) Date of Patent: May 15, 2001

(54) FORMATION PRESSURE MEASUREMENT WHILE DRILLING UTILIZING A NON-ROTATING SLEEVE

(75) Inventors: Reinhart Ciglenec; Alain P. Dorel, both of Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/351,569

(22) Filed: Jul. 12, 1999

Related U.S. Application Data

(60) Provisional application No. 60/097,226, filed on Aug. 20, 1998, and provisional application No. 60/095,252, filed on Aug. 4, 1998.

(51) Int. Cl.[7] ..... E21B 47/01; E21B 17/02; G01V 3/32; G01V 3/18

(52) U.S. Cl. ..... 73/152.01; 73/152.03; 73/152.17; 73/152.46; 166/100; 166/250.16; 175/50

(58) Field of Search ..... 73/152.01, 152.17, 73/152.03, 152.23, 152.25, 152.36, 152.46; 175/50; 166/250.07, 250.16, 117.6, 100, 133

(56) References Cited

U.S. PATENT DOCUMENTS

| | | | | |
|---|---|---|---|---|
| 2,623,594 | * | 12/1952 | Sewell | 166/1 |
| 2,736,967 | * | 3/1956 | Doll | 33/178 |
| 3,163,038 | * | 12/1964 | Bryant | 73/155 |
| 3,934,468 | | 1/1976 | Brieger | 73/155 |
| 4,033,187 | * | 7/1977 | Nicolas | 73/155 |
| 4,167,111 | | 9/1979 | Spuck, III | 73/155 |
| 4,494,072 | * | 1/1985 | Jeter et al. | 324/347 |
| 4,860,581 | | 8/1989 | Zimmerman et al. | 73/155 |
| 4,893,505 | | 1/1990 | Marsden et al. | 73/155 |
| 4,936,139 | | 6/1990 | Zimmerman et al. | 73/155 |
| 5,165,274 | | 11/1992 | Thiercelin | 73/151 |
| 5,181,565 | * | 1/1993 | Czernichow | 166/66 |
| 5,207,104 | | 5/1993 | Enderlin | 73/784 |
| 5,230,244 | * | 7/1993 | Gilhert | 73/155 |

(List continued on next page.)

FOREIGN PATENT DOCUMENTS

| | | |
|---|---|---|
| 0 882 871 A2 | 12/1998 | (EP) . |
| 2 171 436 | 8/1986 | (GB) . |
| WO 96/30628 | 10/1996 | (WO) . |
| WO 99/45234 | 9/1999 | (WO) . |

*Primary Examiner*—Hezron Williams
*Assistant Examiner*—David J. Wiggins
(74) *Attorney, Agent, or Firm*—Steven L. Christian

(57) ABSTRACT

A downhole tool and method are provided for collecting data from a subsurface formation during drilling operations. The tool includes a tubular mandrel adapted for axial connection in a drill string positioned in a wellbore penetrating the subsurface formation and a stabilizer element or sleeve positioned about the tubular mandrel for relative rotation between the stabilizer element and the tubular mandrel. A plurality of elongated ribs are connected to the stabilizer element. A means is connected to the stabilizer element for frictional engagement with a wall of the wellbore so as to prevent the stabilizer element from rotating relative to the wellbore wall. An actuator system is carried at least partially by the stabilizer element, and a probe is carried by one of the elongated ribs and adapted for movement by the actuator system between a retracted position within the one rib and an extended position engaging the wellbore wall such that the probe collects data from the formation. The method includes placing a non-rotating element of a tool positioned in a drill string in engagement with a wall of the wellbore such that the non-rotating element does not move relative to the wellbore wall. A probe carried by the non-rotating element is moved into sealed engagement with the wellbore wall to establish fluid communication between the formation and the non-rotating element, thereby enabling one or more properties of the formation fluid to be sensed.

23 Claims, 7 Drawing Sheets

U.S. PATENT DOCUMENTS

| | | | | |
|---|---|---|---|---|
| 5,302,781 | * | 4/1994 | Hanson, III | 181/102 |
| 5,303,775 | | 4/1994 | Michaels et al. | 166/264 |
| 5,339,036 | * | 8/1994 | Clark et al. | 324/338 |
| 5,353,873 | * | 10/1994 | Cooke, Jr. | 166/253 |
| 5,377,755 | | 1/1995 | Michaels et al. | 166/264 |
| 5,473,939 | * | 12/1995 | Leder et al. | 73/155 |
| 5,549,159 | | 8/1996 | Shwe et al. | 166/250.02 |
| 5,622,223 | | 4/1997 | Vasquez | 166/264 |
| 5,765,637 | | 6/1998 | Dietle et al. | 166/55 |
| 5,810,080 | * | 9/1998 | Meynier | 166/66 |
| 5,810,100 | | 9/1998 | Samford | 175/325.3 |

* cited by examiner

FORMATION PRESSURE MEASUREMENT WHILE DRILLING UTILIZING A NON-ROTATING SLEEVE

CROSS-REFERENCE TO RELATED APPLICATIONS

This application claims priority to U.S. patent application Ser. No. 60/097,226 filed on Aug. 20, 1998 and Ser. No. 60/095,252 filed on Aug. 4, 1998.

BACKGROUND OF THE INVENTION

1. Field of the Invention

This invention relates generally to the determination of various parameters in a subsurface formation penetrated by a wellbore while drilling the wellbore. More particularly, this invention relates to the determination of formation parameters such as formation pressure through the use of a non-rotating drill string stabilizer.

2. Description of the Related Art

Present day oil well operation and production involves continuous monitoring of various subsurface formation parameters. One aspect of standard formation evaluation is concerned with the parameters of reservoir pressure and the permeability of the reservoir rock formation. Continuous monitoring of parameters such as reservoir pressure and permeability indicate the formation pressure change over a period of time, and is essential to predict the production capacity and lifetime of a subsurface formation. Present day operations typically obtain these parameters either through wireline logging via a "formation tester" tool. This type of measurement requires a supplemental "trip", in other words, removing the drill string from the wellbore, running a formation tester into the wellbore to acquire the formation data and, after retrieving the formation tester, running the drill string back into the wellbore for further drilling. Thus, it is typical for formation parameters, including pressure, to be monitored with wireline formation testing tools, such as those tools described in U.S. Pat. Nos.: 3,934,468; 4,860,581; 4,893,505; 4,936,139; and 5,622,223.

Each of the aforementioned patents is therefore limited in that the formation testing tools described therein are only capable of acquiring formation data as long as the wireline tools are disposed in the wellbore and in physical contact with the formation zone of interest. Since "tripping the well" to use such formation testers consumes significant amounts of expensive rig time, it is typically done under circumstances where the formation data is absolutely needed or it is done when tripping of the drill string is done for a drill bit change or for other reasons.

The availability of reservoir formation data on a "real time" basis during well drilling activities is a valuable asset. Real time formation pressure obtained while drilling will allow a drilling engineer or driller to make decisions concerning changes in drilling mud weight and composition as well as penetration parameters at a much earlier time to thus promote the safety aspects of drilling. The availability of real time reservoir formation data is also desirable to enable precision control of drill bit weight in relation to formation pressure changes and changes in permeability so that the drilling operation can be carried out at its maximum efficiency.

It is desirable therefore to provide a method and apparatus for well drilling that enable the acquisition of various formation data from a subsurface zone of interest while the drill string with its drill collars, drill bit and other drilling components are present within the well bore, thus eliminating or minimizing the need for tripping the well drilling equipment for the sole purpose of running formation testers into the wellbore for identification of these formation parameters.

To address these shortcomings, it is a principal object of the present invention to utilize at least one of the drill string components for obtaining such formation parameter data.

More particularly, it is an object of the present invention to utilize a non-rotating stabilizer tool on the drill string for engaging the formation to gather information therefrom.

SUMMARY OF THE INVENTION

The objects described above, as well as various other objects and advantages, are achieved by downhole tool for collecting data from a subsurface formation, including a tubular mandrel adapted for axial connection in a drill string positioned in a wellbore penetrating the subsurface formation and a stabilizer element positioned about the tubular mandrel for relative rotation between the stabilizer element and the tubular mandrel. A plurality of elongated ribs are connected to the stabilizer element. A means is connected to the stabilizer element for frictional engagement with a wall of the wellbore so as to prevent the stabilizer element from rotating relative to the wellbore wall. An actuator system is carried at least partially by the stabilizer element, and a probe is carried by at least one of the elongated ribs and adapted for movement by the actuator system between a retracted position within the one rib and an extended position engaging the wellbore wall such that the probe collects data from the formation.

The elongated ribs are preferably radially spaced apart, and oriented either axially or helically along the stabilizer element.

The frictional engagement means may be provided in the form of various structures, including the plurality of elongated ribs, a plurality of stabilizer blades, or some combination thereof. When the stabilizer blades are selected for providing frictional engagement with the wellbore, it is preferred that each of the blades be positioned between two of the elongated ribs.

The frictional engagement means may further include a spring system for urging the frictional engagement means into contact with the wellbore wall to prevent rotation of the frictional engagement means relative to the wellbore wall. It is preferred that the spring system include a plurality of bow-spring blades each having an inherent spring stiffness.

The probe includes in a preferred embodiment a resilient packer positioned in a substantially cylindrical opening in one of the ribs of the stabilizer element. The packer has a central opening therein. A conduit having an open end is positioned for fluid communication with the central opening in the packer. A filter valve is positioned in the central opening of the packer about the open end of the conduit, and the filter valve is movable between a first position closing the open end of the conduit and a second position permitted filtered formation fluid flow between the formation and the conduit.

The actuator system includes in a preferred embodiment a hydraulic fluid system, and means for selectively pressurizing hydraulic fluid in the hydraulic fluid system. An expandable vessel is placed in fluid communication with the hydraulic fluid system, and the vessel is expanded with increased pressure in the hydraulic fluid and contracted with decreased pressure in the hydraulic fluid. The vessel is preferably a bellows connected to the packer of the probe, such that expansion of the bellows under increased pressure in the hydraulic fluid moves the packer into sealed engagement with the wellbore wall.

The actuator system further includes in a preferred embodiment a sequence valve, operable upon sensing a predetermined pressure in the hydraulic fluid resulting from maximum expansion of the vessel, to move the filter valve of the probe to the second position whereby fluid in the formation can flow into the open end of the conduit.

It is also preferred that the downhole tool of the present invention includes a sensor placed in fluid communication with the probe conduit for measuring a property of the formation fluid. In a preferred embodiment, the sensor is a pressure sensor adapted for sensing the pressure of the formation fluid.

The present invention includes, in another aspect, a method for measuring a property of fluid present in a subsurface formation. The method includes the positioning of a drill string in a wellbore penetrating the subsurface formation. A non-rotating element of a tool positioned in the drill string is placed in engagement with a wall of the wellbore such that the non-rotating element does not move relative to the wellbore wall. A probe carried by the non-rotating element is moved into sealed engagement with the wellbore wall to establish fluid communication between the formation and the non-rotating element.

In a preferred embodiment, fluid is introduced from the formation to a sensor, such as a pressure sensor, carried by the downhole tool for sensing a property of the formation. Such fluid movement is accomplished through the probe, which is adapted for movement by an actuator system between a retracted position within the non-rotating element and an extended position engaging the wellbore wall such that the probe collects data from the formation.

BRIEF DESCRIPTION OF THE DRAWING(S)

So that the manner in which the above recited features, advantages, and objects of the present invention are attained can be understood in detail, a more particular description of the invention, briefly summarized above, may be had by reference to the preferred embodiments thereof which are illustrated in the appended drawings.

It is to be noted however, that the appended drawings illustrate only typical embodiments of this invention and are therefore not to be considered limiting of its scope, for the invention may admit to other equally effective embodiments.

DESCRIPTION OF THE PREFERRED EMBODIMENTS

Figure 1:
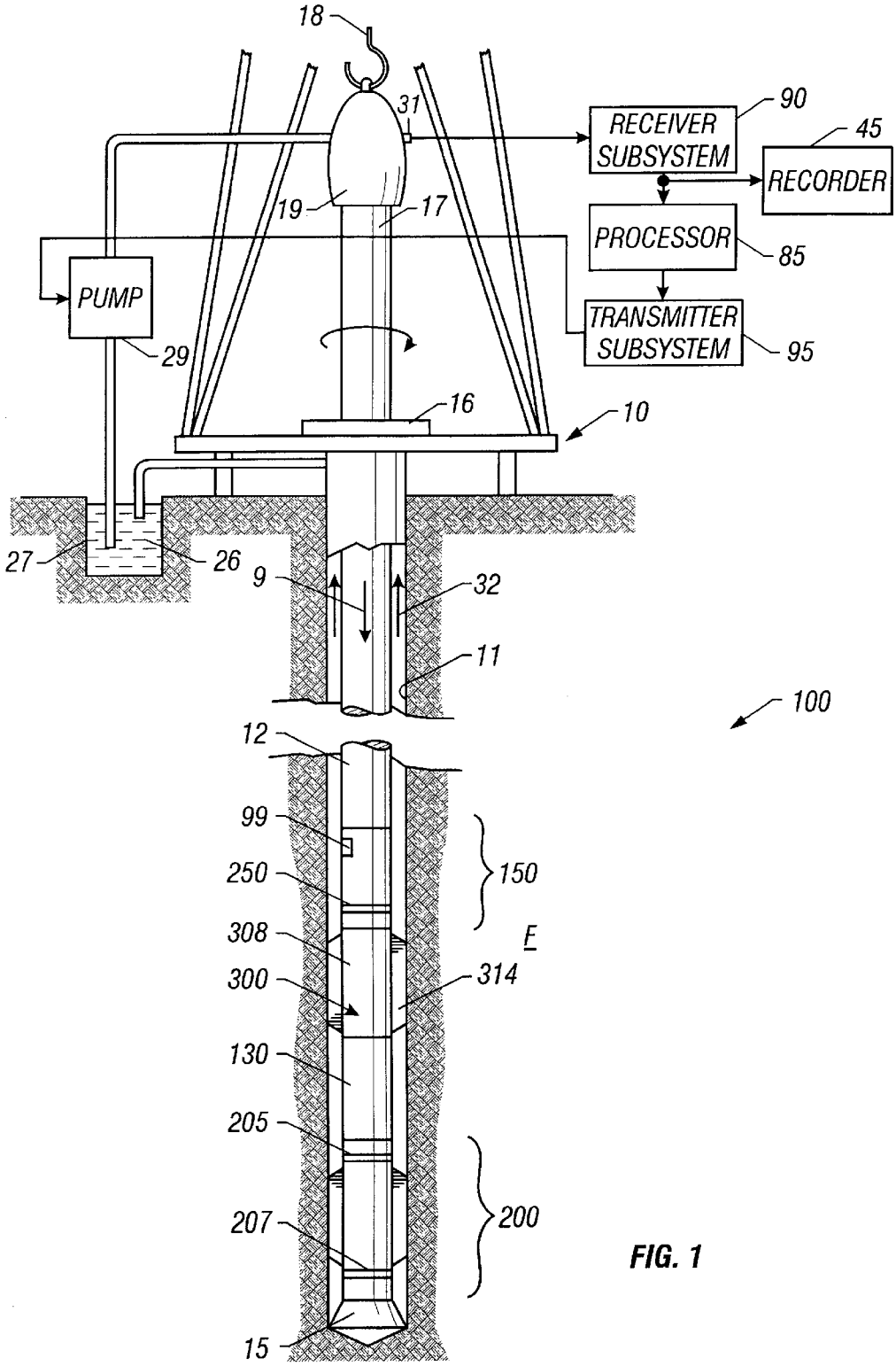
FIG. 1 is an elevational view, partially in section and partially in block diagram, of a conventional drilling rig and drill string employing the present invention.

FIG. 1 illustrates a convention drilling rig and drill string in which the present invention can be utilized to advantage. Land-based platform and derrick assembly 10 are positioned over wellbore 11 penetrating subsurface formation F. In the illustrated embodiment, wellbore 11 is formed by rotary drilling in a manner that is well known. Those of ordinary skill in the art given the benefit of this disclosure will appreciate, however, that the present invention also finds application in directional drilling applications as well as rotary drilling, and is not limited to land-based rigs.

Drill string 12 is suspended within wellbore 11 and includes drill bit 15 at its lower end.

Drill string 12 is rotated by rotary table 16, energized by means not shown, which engages kelly 17 at the upper end of the drill string. Drill string 12 is suspended from hook 18, attached to a traveling block (also not shown), through kelly 17 and rotary swivel 19 which permits rotation of the drill string relative to the hook.

Drilling fluid or mud 26 is stored in pit 27 formed at the well site. Pump 29 delivers drilling fluid 26 to the interior of drill string 12 via a port in swivel 19, inducing the drilling fluid to flow downwardly through drill string 12 as indicated by directional arrow 9. The drilling fluid exits drill string 12 via ports in drill bit 15, and then circulates upwardly through the region between the outside of the drillstring and the wall of the wellbore, called the annulus, as indicated by direction arrows 32. In this manner, the drilling fluid lubricates drill bit 15 and carries formation cuttings up to the surface as it is returned to pit 27 for recirculation.

Drillstring 12 further includes a bottom hole assembly, generally referred to as 100, near the drill bit 15 (in other words, within several drill collar lengths from the drill bit). The bottom hole assembly includes capabilities for measuring, processing, and storing information, as well as communicating with the surface. Bottom hole assembly 100 thus includes, among other things, measuring and local communications apparatus 200 for determining and communicating the resistivity of formation F surrounding wellbore 11. Communications apparatus 200, including transmitting antenna 205 and receiving antenna 207, is described in detail in U.S. Pat. No. 5,339,037, commonly assigned to the assignee of the present application, the entire contents of which are incorporated herein by reference.

Assembly 100 further includes drill collar 130 for performing various other measurement functions, and surface/local communications subassembly 150. Subassembly 150 includes toroidal antenna 250 used for local communication with apparatus 200, and a known type of acoustic communication system that communicates with a similar system (not shown) at the earth's surface via signals carried in the drilling fluid or mud. Thus, the surface communication system in subassembly 150 includes an acoustic transmitter which generates an acoustic signal in the drilling fluid that is representative of measured downhole parameters.

One suitable type of acoustic transmitter employs a device known as a "mud siren" which includes a slotted stator and a slotted rotor that rotate and repeatedly interrupt the flow of drilling fluid to establish a desired acoustical wave signal in the drilling fluid. The driving electronics in subassembly 150 may include a suitable modulator, such as a phase shift keying (PSK) modulator, which conventionally produces driving signals for application to the mud transmitter. These driving signals can be used to apply appropriate modulation to the mud siren.

The generated acoustical wave is received at the surface by transducers represented by reference numeral 31. The transducers, for example, piezoelectric transducers, convert the received acoustical signals to electronic signals. The output of transducers 31 is coupled to uphole receiving subsystem 90, which demodulates the transmitted signals. The output of receiving subsystem 90 is then couple to processor 85 and recorder 45.

Uphole transmitting system 95 is also provided, and is operative to control interruption of the operation of pump 29 in a manner that is detectable by transducers 99 in subassembly 150. In this manner, there is two-way communication between subassembly 150 and the uphole equipment. Subassembly 150 is described in greater detail in U.S. Pat. No. 5,235,285, the entire contents of which are also incorporated herein by reference. Those skilled in the art will appreciate that alternative acoustic, as well as other techniques, can be employed for communication with the surface.

Drill string 12 is further equipped in the embodiment of FIG. 1 with stabilizer collar 300. Such stabilizing collars are utilized to address the tendency of the drill string to "wobble" and become decentralized as it rotates within the wellbore, resulting in deviations in the direction of the wellbore from the intended path (for example, a straight vertical line). Such deviation can cause excessive lateral forces on the drill string sections as well as the drill bit, producing accelerated wear. This action can be overcome by providing a means for centralizing the drill bit and, to some extent, the drill string, within the wellbore. Examples of centralizing tools that are known in the art include pipe protectors and other tools, in addition to stabilizers. A particular embodiment of the present invention will now be described in terms of a non-rotating drill string stabilizer.

Figure 2:
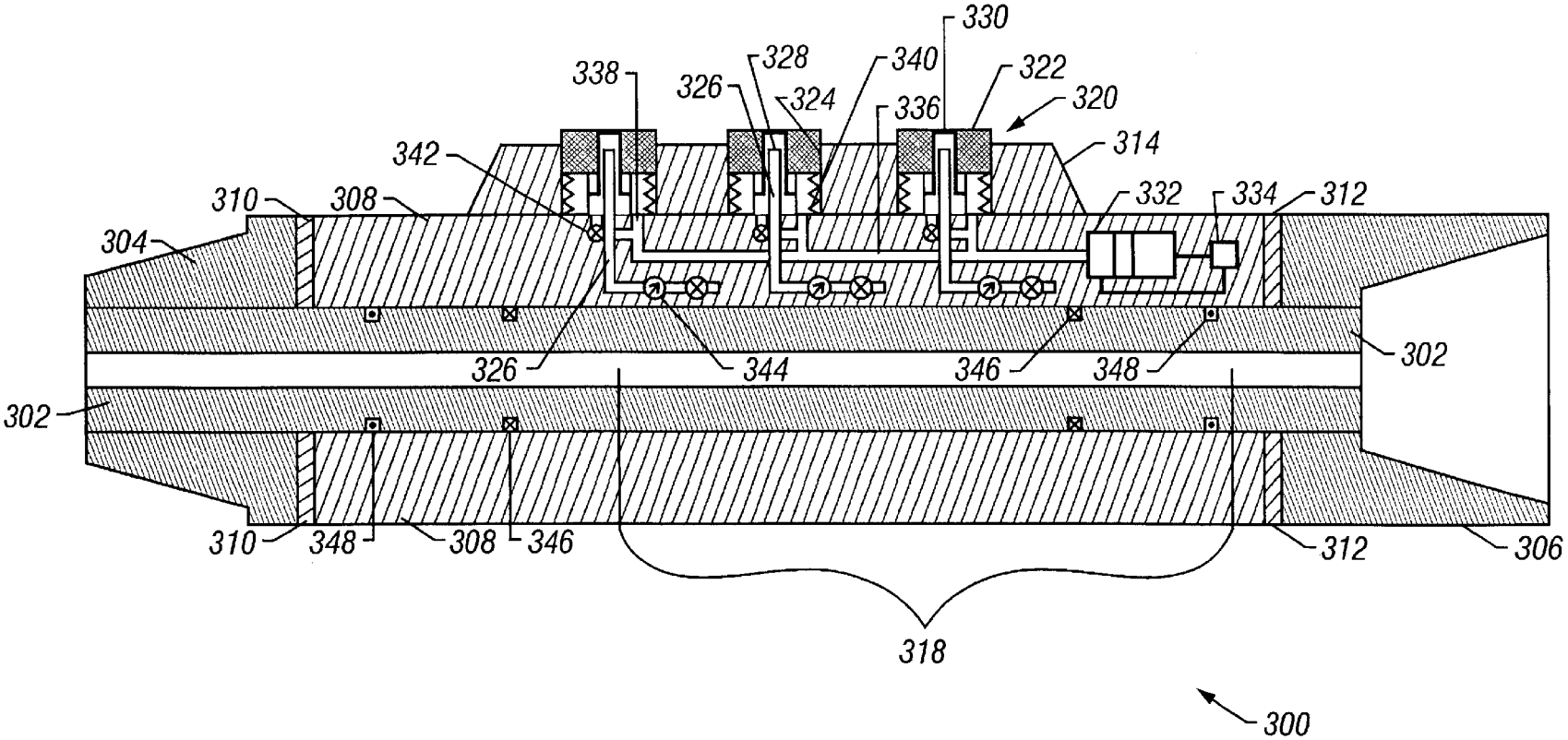
FIG. 2 is a sectional view of a non-rotating stabilizer, in accordance with one embodiment of the present invention, equipped with elongated ribs having probe assemblies therein.
Figure 4:
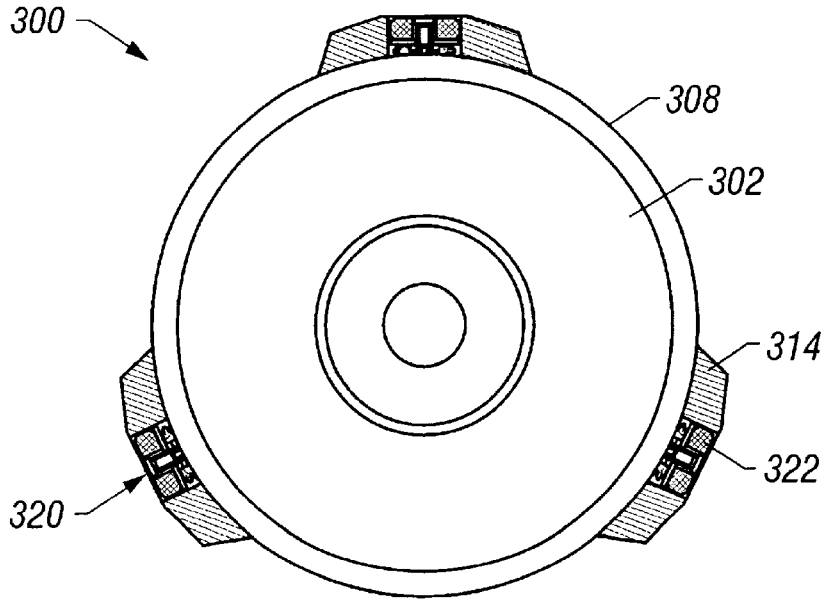
FIG. 4 is a plan view, taken in section, of the non-rotating stabilizer of FIG. 2.
Figure 5:
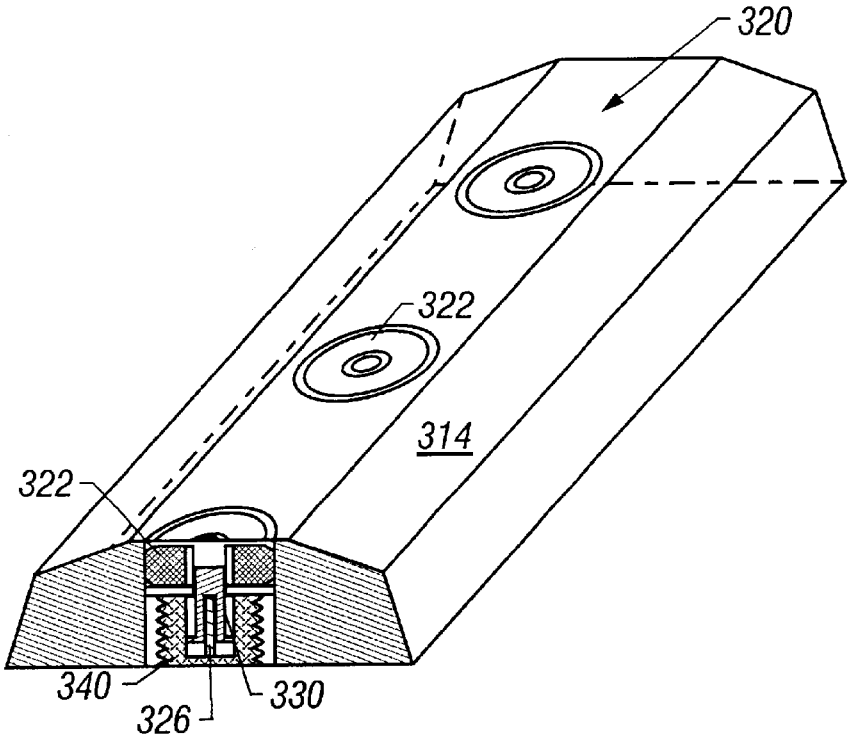
FIG. 5 is a perspective view, partially in section, of one of the elongated ribs of FIG. 4, particularly illustrating the use of multiple probes on the elongated rib.

In addition to FIG. 1, FIGS. 2 and 4 illustrate a preferred embodiment of a downhole tool in accordance with the present invention for collecting data from a subsurface formation. The downhole tool is provided as non-rotating stabilizer 300 having a tubular mandrel 302 adapted for axial connection in drill string 12. Thus, mandrel 302 may be equipped with pin and box ends 304, 306 for conventional make-up within the drill string. As shown in FIG. 2, ends 304, 306 may be customized collars that are connected to the central elongated portion of mandrel 302 in a conventional manner, such as threaded engagement and/or welding.

Stabilizer 300 further includes non-rotating stabilizer element or sleeve 308 positioned about tubular mandrel 302 between ends 304 and 306 in such a manner as to permit relative rotation between the stabilizer element and the tubular mandrel. Thrust bearings 310, 312 are provided to reduce the frictional forces and bear the axial loads developed at the axial interface between sleeve 308 and mandrel ends 304, 306. Rotary seals 348 and radial bearings 346 are also provided at the radial interface between mandrel 302 and sleeve 308.

A plurality of elongated ribs 314 are connected, such as by welding or bolting, to the exterior surface of stabilizer sleeve 308. The elongated ribs are preferably radially spaced apart, and oriented either axially, as indicated in FIGS. 1, 2, and 4, or helically (not shown) along the non-rotating stabilizer sleeve. It is presently preferred that the non-rotating sleeve include three such ribs 314 spaced 120° apart about the circumference of the sleeve, as indicated in FIG. 4. The present invention is not limited to a three-rib embodiment, however, and may be utilized to advantage with other arrangements of the elongated ribs. The purpose of multiple ribs is to increase the likelihood of effecting a proper seal with the wellbore wall, as will be explained further below.

Figure 3:
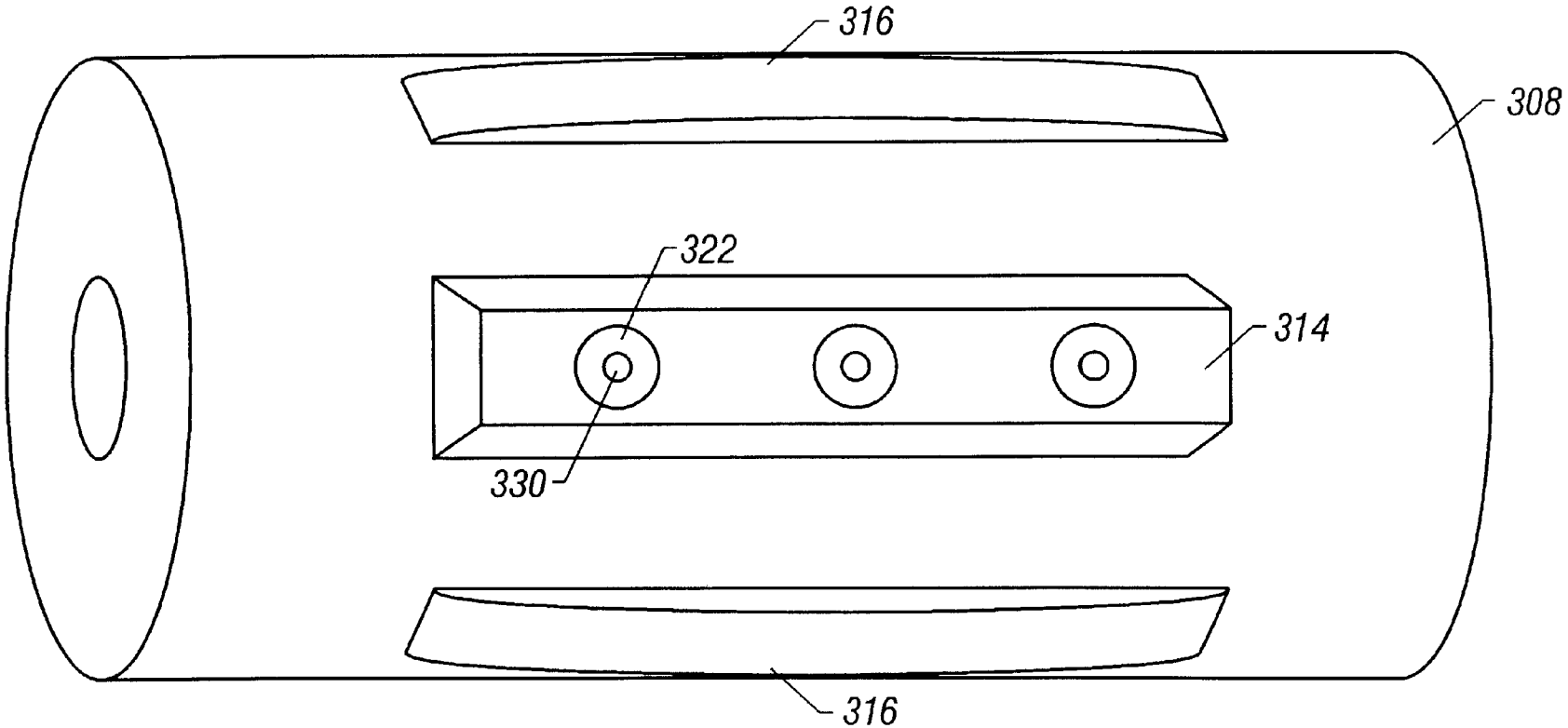
FIG. 3 is a perspective view of a non-rotating sleeve of a stabilizer, in accordance with another embodiment of the present invention, equipped with elongated ribs and stabilizer blades.

A means is connected to stabilizer sleeve 308 for frictional engagement with a wall of wellbore 11 so as to prevent the stabilizer sleeve from rotating relative to the wellbore wall. The frictional engagement means may be provided in the form of various structures, including the plurality of elongated ribs 314, or as a plurality of stabilizer blades 316. FIG. 3 illustrates an alternative embodiment wherein both elongated ribs 314 and stabilizer blades 316 are included, with the blades providing at least a substantial portion of the frictional engagement required to prevent stabilizer element or sleeve 308 from rotating relative to the wellbore wall. When the stabilizer blades are selected, it is preferred that each of the blades 316 be positioned between two of the elongated ribs 314 as seen in FIG. 3.

The frictional engagement means may further include a spring system for urging such frictional engagement means into contact with the wellbore wall, thereby crating a greater friction force to resist rotation of sleeve 308 relative to the wellbore wall. In the embodiment of FIG. 3, such a spring system is provided by selecting a plurality of bow-spring blades 316 each having an inherent spring stiffness. Those skilled in the art given the benefit of this disclosure will appreciate, however, that a spring system could be provided through elongated ribs 314, such as in the embodiment of the present invention that lacks stabilizer blades 316.

It will further be appreciated that various other means for inducing frictional engagement between stabilizer sleeve 308 and wellbore 11 may be utilized, including, for example, hydraulically actuating assemblies for moving the elongated ribs/blades and/or various stabilizer piston assemblies (not shown) radially outwardly so as to induce firm engagement with the wall of the wellbore and prevent rotation between element 308 and the wellbore wall.

Figure 6:
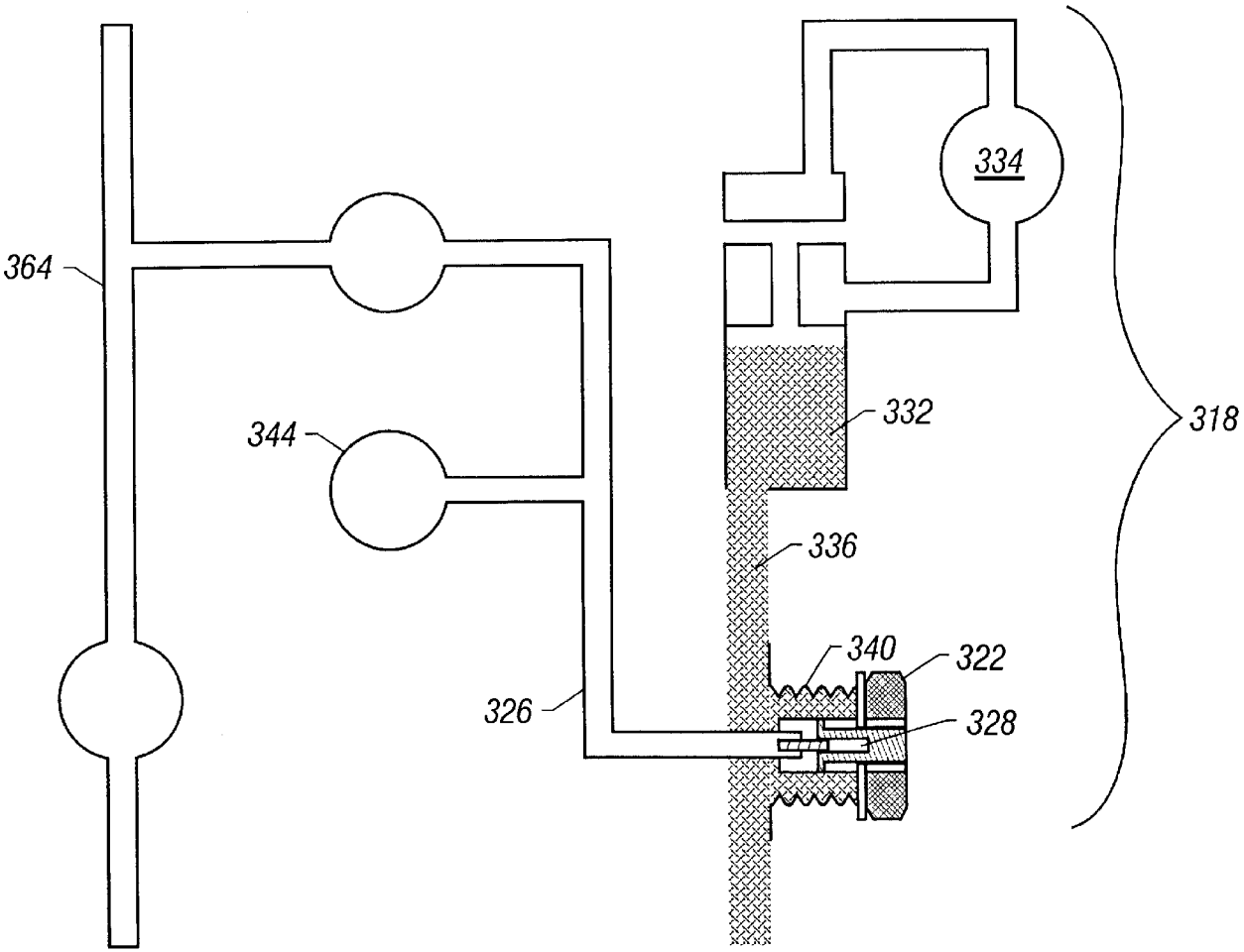
FIG. 6 is a fluid flow schematic illustrating the movement of fluid from the formation through the non-rotating stabilizer for sensing one or more properties of the fluid, such as pressure.
Figure 7:
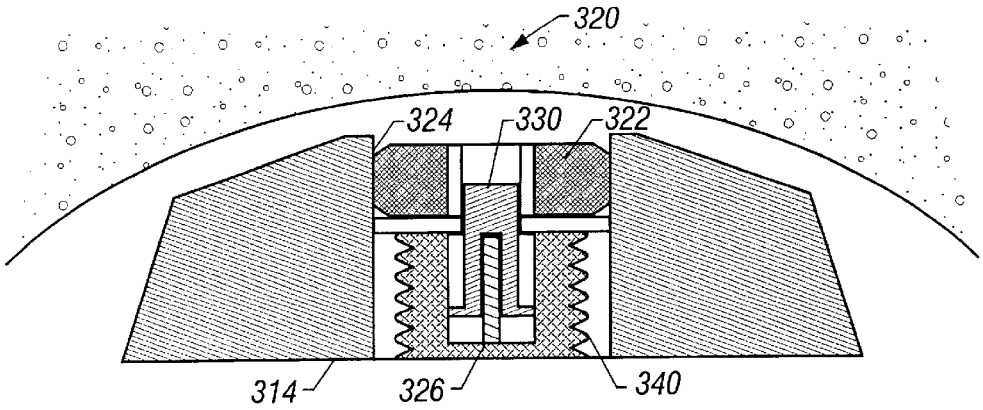
FIG. 7 is a sectional view of one of the probes in a retracted position within an elongated rib of the non-rotating stabilizer.
Figure 8:
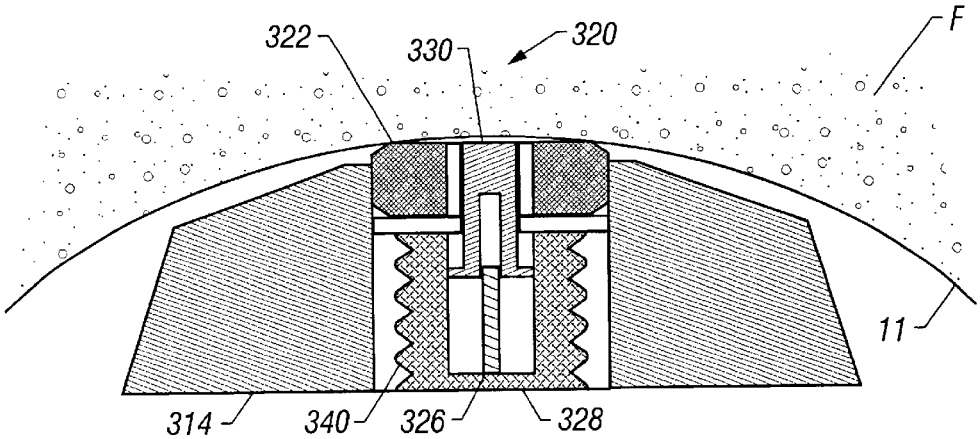
FIG. 8 is a sectional view of the probe of FIG. 6 in an extended position and engaging a wall of the wellbore.

A probe actuator system, generally referred to as 318 is carried at least partially by non-rotating stabilizer sleeve 308, and is shown in FIGS. 2 and 6. In a presently preferred embodiment, three probes 320 are carried by each of the elongated ribs 314 and adapted for movement by actuator system 318 between a retracted position within the rib, as shown in FIG. 7, and an extended position engaging the wellbore wall such that the probe collects data from the formation, as shown in FIGS. 2 and 8.

Each probe includes in a preferred embodiment a resilient annular packer 322 positioned in a substantially cylindrical opening or cavity 324 that extends through one of elongated ribs 314, as indicated in FIG. 2. Each packer 322 is imbedded, in the retracted probe position, within opening or recess 324 in rib 314, as shown in FIG. 7, so that the packer (typically made of a resilient material such as vulcanized rubber) is not damaged by the abrasive forces encountered by stabilizer 300 during drilling operations. Conduit 326 having open end or nozzle 328 is positioned for fluid communication through and with a central opening in the packer. Filter valve 330 is also positioned in the central opening of packer 322 about open end 328 of conduit 326. The filter valve is movable between a first position closing the open end of the conduit, as shown in FIG. 7, and a second position permitting filtered formation fluid flow between the formation and the conduit, as shown in FIGS. 2 and 8.

With reference again to FIGS. 2 and 6, actuator system 318 further includes a hydraulic fluid system containing hydraulic fluid reservoir 332, hydraulic fluid pump 334, and hydraulic fluid flow line 336 for selectively pressurizing hydraulic fluid in the hydraulic fluid system. An expandable vessel, more particularly flexible metal bellows 340, within each cylindrical opening 324 is placed in fluid communication with the hydraulic fluid system by way of flow line 338 (see FIG. 2) branching off of flow line 336. It is preferred that each of the probes 320 residing on a single elongated rib 314 are connected to a common reservoir 332. In a particular embodiment, each of the probes residing on all ribs 314 are commonly connected to the same hydraulic fluid reservoir.

Bellows 340 is expanded in a conventional manner with increased pressure in the hydraulic fluid and similarly contracted with decreased pressure in the hydraulic fluid. Bellows 340 is connected to packer 322, such that expansion of the bellows under increased pressure in the hydraulic fluid moves the packer into sealed engagement with the wellbore wall, as indicated in FIG. 8. A comparison of FIGS. 7 and 8 illustrates that each probe 320 has a short piston stroke resulting from the expansion/contraction of bellows 340.

Electrical power transfer to non-rotating stabilizer 300 can be accomplished in various ways. One option (not shown) involves the imbedding of permanent magnets in a cylindrical arrangement within the mandrel about its circumference, and the imbedding of an annular conducting coil within the non-rotating sleeve about the magnets. Thus, rotation of the mandrel relative to the non-rotating sleeve will generate an alternating electric current within the coil which can be converted to direct current for appropriate use in stabilizer 300.

Figure 9:
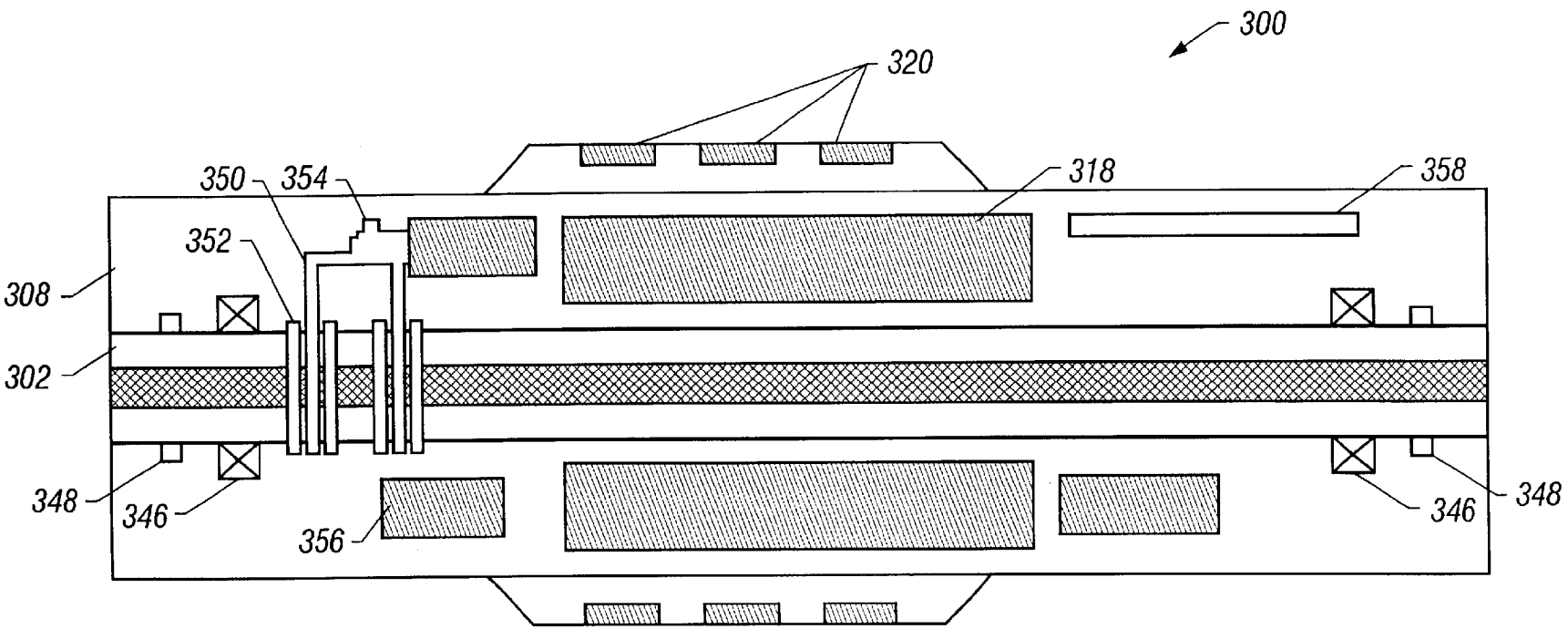
FIG. 9 is a schematic of the non-rotating stabilizer with block representations for power generation and data communication components.

Another option for transmitting power to non-rotating stabilizer 300 is depicted schematically in FIG. 9, wherein a portion of the drilling fluid or mud is deviated from the center of mandrel 302 in bypass loop 350 equipped with rotating seals 352. The drilling mud in the bypass loop is directed through a small turbine 354 located in non-rotating sleeve 308.

A probe "set" sequence is initiated by energizing pump 334 with the energy generated through turbine 354 to increase the hydraulic fluid pressure in reservoir 332. Pump 334 is selectively energized by a conventional control system (not shown) that regulates either electrical power or direct torque applied to the pump. The pressure increase in reservoir 332 increases the fluid pressure in flow line 336, and forces each probe 320 connected to the flow line out of its individual opening or cavity 324. Since the elongated ribs 314 are typically engaging the wellbore wall during standard drilling operations, a very small piston stroke is required to effect a seal between packers 322 of probes 320 and the wall of wellbore 12. Bellows 340 is also designed to provide sufficient freedom and articulation of movement to accommodate adjustments of packer 322 to local wellbore ruggedness.

Actuator system 318 further includes in a preferred embodiment one sequence valve 342 for each probe 320. The sequence valve is connected to flow line 338, as shown in FIG. 2, and is operable upon sensing a predetermined pressure in the hydraulic fluid resulting from maximum expansion of each of the bellows 340. Upon sensing such predetermined pressure, each sequence valve 342 opens, releasing hydraulic fluid to pressurize the region of cylindrical opening 324 under filter valve 330 and bounded by bellows 340 to move the filter valve to the second, upper position whereby fluid in the formation can flow into open end 328 of conduit 326. As a result, a small formation fluid draw-down is initiated at each probe.

Sensor 344 is placed in fluid communication with the probe conduit for measuring a property of the formation fluid drawn through conduit 326. In a preferred embodiment, sensor 344 is a pressure sensor adapted for sensing the pressure of the formation fluid, such as a strain gauge, Mems gauge, or crystal gauge. Sensor 344 provides the capability of sensing and recording pressure data, and transmitting signals representative of such pressure data via electronics package 356 to receiver circuitry within a data receiver, such as within subassembly 150 described above, for further transmission through drill string 12 in a manner that is known in the art. Thus, two-way data communication may be ensured through a known electromagnetic transceiver system, as described in U.S. Pat. No. 5,235,285. It will be appreciated in this regard that sensor electronics 356 may be designed to communicate with a transceiver within mandrel 302 as well as a transceiver above or below non-rotating stabilizer 300.

While sensor 344 is described herein for use with pressure data only, the present invention further contemplates the use of sensors and related electronics that are adapted for sensing, recording, and transmitting data representative of other formation parameters, such as temperature and fluid composition. Such sensors need only be placed in contact with the formation fluid at some point in the fluid flow line 326, such as at a measuring junction which permits the sensor to acquire the desired formation parameter data.

The hydrostatic pressure from the wellbore annulus is measured (with other known means) and compared with the respective pressure values obtained from the various probes 320 and sensors 344. A probe with a bad seal will, despite the draw down, continue to monitor hydrostatic pressure in the wellbore annulus. The pressure measurement of such a probe would hence be disregarded. The weighted average of all "good" pressures is then taken as the formation pressure in the vicinity of stabilizer 300. Upon completion of the pressure test (or other parameter test), a "retract" cycle is initiated by pumping hydraulic fluid back into reservoir 332 using pump 334. This reduces the pressure in flow line 336, and the individual probes 320 retract back into their respective rib openings or cavities 324. The sequence is finished when sequence valves 342 close and the remaining formation fluid in flow line is pushed back out into the borehole by the relative movement between filter valve 330 and conduit nozzle 328.

One of the advantages provided by the present invention results from the fact that during a drilling operation the orientation of a particular elongated rib 314 with respect to the wellbore is not known at any given point in time, nor can it be adjusted within any satisfactory accuracy. Therefore the resulting position of a single probe and packer could be at an unfavorable angle to the wellbore wall, preventing a proper seal and, consequently, reducing the likelihood of a successful pressure test, or other data acquisition.

The placement of a plurality of probes on a non-rotating stabilizer rib, and the use of a plurality of such non-rotating ribs, assures redundancy and increases the likelihood that at least one of the probes will effect a proper seal and obtain a successful pressure test (or permit the acquisition of other formation data). By utilizing two, three, or even four probes next to each other per elongated rib 314, the coverage of the investigated wellbore wall surface is expanded. Thus, chances for a good contact are further increased.

Those given the benefit of this disclosure will appreciate that the present invention provides a new option for acquiring formation data during drilling operations. As part of a Measurement-While-Drilling/Logging-While-Drilling (MWD/LWD) system, the present invention may be used to advantage with various types of nuclear, resistivity, and acoustic tools and measurements, among others. A presently preferred embodiment, as described above, may be used to advantage in Formation-Pressure-While-Drilling (FPWD) applications.

Compared to the known MWD/LWD tools, a non-rotating stabilizer in accordance with the present invention provides a relatively shock and vibration free environment for sensing parameters of a formation. Regardless of the overall drilling operation, such a non-rotating stabilizer will typically experience primarily lateral sliding motions along it's longitudinal axis. This fact is favorable for numerous measurements which rely on fragile components, or which require that no rotation occurs during the data acquisition.

The present invention is also adaptable for obtaining samples of formation fluid when connected to sample chambers such as those described in U.S. Pat. Nos. 4,860,581 and 4,936,139. Such sample chambers could be positioned within non-rotating sleeve 308 and connected to flow line 326 via isolation valve 360, flow line bus 364, and main isolation valve 362, as shown in FIG. 6. Since such a non-rotating sleeve will experience minor abrasive forces during drilling operations, only little additional protection for those sample chambers would be required.

In view of the foregoing it is evident that the present invention is well adapted to attain all of the objects, advantages, and features hereinabove set forth, together with other objects, advantages, and features which are inherent in the apparatus disclosed herein.

As will be readily apparent to those skilled in the art, the present invention may easily be produced in other specific forms without departing from its spirit or essential characteristics. The presently disclosed embodiments are, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A downhole tool for collecting data from a subsurface formation, comprising:

a tubular mandrel adapted for axial connection in a drill string positioned in a wellbore penetrating the subsurface formation;

a stabilizer element positioned about the tubular mandrel for relative rotation between the stabilizer element and the tubular mandrel;

a plurality of elongated ribs connected to the stabilizer element;

means connected to the stabilizer element for frictional engagement with a wall of the wellbore, such frictional engagement preventing the stabilizer element from rotating relative to the wellbore wall;

an actuator system carried at least partially by the stabilizer element; and a probe carried by one of the elongated ribs and adapted for movement by the actuator system between a retracted position within the one rib and an extended position engaging the wellbore wall such that the probe collects data from the formation.

2. The downhole tool of claim 1, wherein the elongated ribs are radially spaced apart and oriented axially along the stabilizer element.

3. The downhole tool of claim 1, wherein the elongated ribs are radially spaced apart and oriented helically along the stabilizer element.

4. The downhole tool of claim 1, wherein the frictional engagement means includes the plurality of elongated ribs.

5. The downhole tool of claim 1, wherein the frictional engagement means includes a plurality of stabilizer blades, each of the blades being positioned between two of the elongated ribs.

6. The downhole tool of claim 1, wherein the frictional engagement means includes a spring system for urging the frictional engagement means into contact with the wellbore wall to prevent rotation of the frictional engagement means relative to the wellbore wall.

7. The downhole tool of claim 6, wherein the spring system includes a plurality of bow-spring blades each having an inherent spring stiffness.

8. The downhole tool of claim 1, wherein the probe includes a resilient packer positioned in a substantially cylindrical opening in one of the ribs of the stabilizer element, the packer having a central opening therein;

a conduit having an open end positioned for fluid communication with the central opening in the packer; and a filter valve positioned in the central opening of the packer about the open end of the conduit, the filter valve being movable between a first position closing the open end of the conduit and a second position permitting filtered formation fluid flow between the formation and the conduit.

9. The downhole tool of claim 1, wherein the actuator system includes a hydraulic fluid system;

means for selectively pressurizing hydraulic fluid in the hydraulic fluid system;

an expandable vessel in fluid communication with the hydraulic fluid system, the vessel being expanded with increased pressure in the hydraulic fluid and contracted with decreased pressure in the hydraulic fluid.

10. The downhole tool of claim 8, wherein the actuator system includes a hydraulic fluid system;

means for selectively pressurizing the hydraulic fluid in the hydraulic fluid system;

an expandable bellows in fluid communication with the hydraulic fluid system and connected to the packer, the bellows being expanded with increased pressure in the hydraulic fluid to move the packer into sealed engagement with the wellbore wall.

11. The downhole tool of claim 10, wherein the actuator system further comprises a sequence valve that operates upon sensing a predetermined pressure in the hydraulic fluid resulting from maximum expansion of the bellows to move the filter valve to the second position whereby fluid in the formation can flow into the open end of the conduit.

12. The downhole tool of claim 8, further comprising a sensor placed in fluid communication with the conduit for measuring a property of the formation fluid.

13. The downhole tool of claim 12, wherein the sensor is a pressure sensor adapted for sensing the pressure of the formation fluid.

14. The downhole tool of claim 1, wherein the downhole tool is a non-rotating stabilizer.

15. A downhole tool for collecting data from a subsurface formation, comprising:

a tubular mandrel adapted for axial connection in a drill string positioned in a wellbore penetrating the subsurface formation;

a stabilizer element positioned about the tubular mandrel for relative rotation between the stabilizer element and the tubular mandrel;

a plurality of elongated ribs connected to the stabilizer element for frictional engagement with a wall of the wellbore, such frictional engagement preventing the stabilizer element from rotating relative to the wellbore wall;

an actuator system carried at least partially by the stabilizer element; and a probe carried by one of the elongated ribs and adapted for movement by the actuator system between a retracted position within the one rib and an extended position engaging the wellbore wall such that the probe collects data from the formation.

16. A downhole tool for collecting data from a subsurface formation, comprising:

a tubular mandrel adapted for axial connection in a drill string positioned in a wellbore penetrating the subsurface formation;

a stabilizer element positioned about the tubular mandrel for relative rotation between the stabilizer element and the tubular mandrel;

a plurality of elongated ribs connected to the stabilizer element, the ribs being radially spaced apart from one another;

a plurality of stabilizer blades connected to the stabilizer element for frictional engagement with a wall of the wellbore, such frictional engagement preventing the stabilizer element from rotating relative to the wellbore wall;

an actuator system carried at least partially by the stabilizer element; and a probe carried by one of the elongated ribs and adapted for movement by the actuator system between a retracted position within the one rib and an extended position engaging the wellbore wall such that the probe collects data from the formation.

17. The downhole tool of claim 16, wherein each of the stabilizer blades is positioned between two of the elongated ribs.

18. The downhole tool of claim 16, wherein each of the stabilizer blades includes a bow spring having an inherent spring stiffness to urge the stabilizer blade into frictional engagement with the wellbore wall.

19. A method for measuring a property of fluid present in a subsurface formation, comprising:

positioning a drill string in a wellbore penetrating the subsurface formation;

placing a non-rotating element of a tool positioned in the drill string in engagement with a wall of the wellbore such that the non-rotating element does not move relative to the wellbore wall; and moving a probe carried by the non-rotating element into sealed engagement with the wellbore wall to establish fluid communication between the formation and the non-rotating element.

20. The method of claim 19, further comprising introducing fluid from the formation to a sensor carried by the downhole tool for sensing a property of the formation.

21. The method of claim 20, wherein the sensor is a pressure sensor adapted for sensing formation fluid pressure.

22. The method of claim 21, wherein the probe is adapted for movement by an actuator system between a retracted position within the non-rotating element and an extended position engaging, the wellbore wall such that the probe collects data from the formation.

23. The method of claim 22, wherein the probe includes a resilient packer positioned in a substantially cylindrical opening in the non-rotating element, the packer having a central opening therein;

a conduit having an open end positioned for fluid communication with the central opening in the packer; and a filter valve positioned in the central opening of the packer about the open end of the conduit, the filter valve being movable between a first position closing the open end of the conduit and a second position permitted filtered formation fluid flow between the formation and the conduit.

* * * * *